US006561776B2

(12) United States Patent
Morozumi

(10) Patent No.: US 6,561,776 B2
(45) Date of Patent: May 13, 2003

(54) SCROLL COMPRESSOR

(75) Inventor: Naoya Morozumi, Kawasaki (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 10/000,099

(22) Filed: Dec. 4, 2001

(65) Prior Publication Data

US 2002/0119063 A1 Aug. 29, 2002

(30) Foreign Application Priority Data

Feb. 28, 2001 (JP) ..... 2001-053396

(51) Int. Cl.[7] ..... F04C 18/00
(52) U.S. Cl. ..... 418/55.5; 418/57; 418/55.1
(58) Field of Search ..... 418/55.5, 57, 55.1

(56) References Cited

U.S. PATENT DOCUMENTS 4,522,575 A * 6/1985 Tischer et al. ..... 418/55.5
6,389,837 B1 * 5/2002 Morozumi ..... 418/55.5

FOREIGN PATENT DOCUMENTS

JP 58079684 A * 5/1983 ..... F04C/18/02
JP 05149267 A * 6/1993 ..... F04C/18/02
JP 2000303969 A * 10/2000 ..... F04C/18/02

* cited by examiner

*Primary Examiner*—Thomas Denion
*Assistant Examiner*—Theresa Trieu
(74) *Attorney, Agent, or Firm*—Kanesaka & Takeuchi

(57) ABSTRACT

In order to give appropriate back pressure to an orbiting-scroll during any operation, on one end side of a cylindrical thrust ring, there is provided a flange portion, and a movable range of the orbiting-scroll in an axial direction with respect to a regulation surface of a main frame is indirectly regulated through this flange portion, on the flange portion, there is provided a groove, and the groove is caused to communicate to a first back-pressure chamber at a low-pressure side.

6 Claims, 4 Drawing Sheets

SCROLL COMPRESSOR

TECHNICAL FIELD

The present invention relates to a scroll compressor for use in a refrigerating cycle for an air conditioner or the like, and more particularly to a scroll compressor lower-priced in structure having good compression efficiency.

BACKGROUND ART

Most of recent air conditioners have used a scroll compressor having good compression efficiency. FIG. 6 shows its one example. This scroll compressor 1 has a cylindrically-formed hermetic shell 2, and its interior is partitioned into a refrigerant discharge chamber R1 and a driving chamber R2 by means of a main frame 4.

Within the refrigerant discharge chamber R1, there is housed a refrigerant compressing section 3 comprising a fixed-scroll 31 having voluted scrolled-wrap 312 on a base plate 311 and an orbiting-scroll 32 to be driven by an electric motor engaged.

An electric motor is housed within the driving chamber R2 although not shown, and a predetermined amount of lubricating oil is stored. One end of a driving shaft 6 of the electric motor penetrates the main frame 4, and a crankshaft 61 at its tip end is connected to a boss 323 on the back surface of the base plate 321 of the orbiting-scroll 32.

When the scroll compressor 1 is driven, low-pressure refrigerant, which has finished the work in the refrigerating cycle, is sucked in from an outer periphery side of a compressing chamber 33 through a refrigerant suction pipe 21, is more compressed as it goes toward the center of the vortex, and is discharged into the refrigerant discharge chamber R1 from a discharge port 34 provided at the center as high-pressure refrigerant. The high-pressure refrigerant thus discharged is conducted into the driving chamber R2 through a by-pass pipe 35, and thereafter, is supplied from a refrigerant discharge pipe 22 again into the refrigerating cycle.

At the time of this refrigerant compression operation, pressure is always applied onto the orbiting-scroll 32 from within the compressing chamber 33 in a direction that departs from the fixed-scroll 31. Further, as it goes from the outer periphery side (low-pressure refrigerant suction side) of the vortex toward the center, the pressure has a pressure gradient to shift from low pressure to high pressure. Therefore, it is necessary to prevent the orbiting-scroll 32 from being lifted by applying such back-pressure as to resist the pressure to the orbiting-scroll 32.

In this conventional example, in order to apply back-pressure corresponding to the pressure gradient to the orbiting-scroll 32, on the back surface side of the orbiting-scroll 32, there is provided a thrust ring 5 to thereby divide into a first back-pressure chamber LR (low-pressure side) on the peripheral portion side and a second back-pressure chamber HR (high-pressure side) on the central portion side. Thereby, to the second back-pressure chamber HR, the high pressure within the driving chamber R1 is applied, while to the first back-pressure chamber LR, lower pressure on the low-pressure refrigerant side than the second back-pressure chamber HR is applied.

At the time of starting or the like, however, since no high pressure is developed within the hermetic shell 2, no appropriate back pressure is applied to the orbiting-scroll 32, but a compression failure may possibly be caused. Thus, in order to regulate a movable range of the orbiting-scroll 32 in the axial direction, the main frame 4 has been provided with a regulation surface 41 to physically regulate the movable range of the orbiting-scroll 32 for preventing any compression failure.

Also, apart from this, there has also been proposed a type in which, on the main frame 4 opposite to the back surface of the thrust ring 5, there is provided a second regulation surface 411 to indirectly regulate the movable range of the orbiting-scroll 32 in the axial direction through the thrust ring 5. In either of these types, however, there has been a problem that it is necessary to individually machine each regulation surface 41, 411 with high precision, and as a result, the cost will become higher.

SUMMARY OF THE INVENTION

The present invention has been achieved in order to solve the above-described problem, and is aimed to provide a low-cost scroll compressor which is stable even in an operating state with a small difference in pressure such as during starting by indirectly regulating the movable range of the orbiting-scroll through the thrust ring.

In order to attain the above-described object, a scroll compressor according to the present invention in which between the base plate back surface of the orbiting-scroll and the main frame, there is provided a thrust ring, and in which one end surface of the thrust ring seals in slidable contact with the base plate back surface of the orbiting-scroll to thereby partition the base plate back surface of the orbiting-scroll into a plurality of pressure space, is characterized in that the thrust ring has a main body of a ring to be fitted along an inner peripheral surface of the main frame, and a flange portion having a larger outer diameter than an outer diameter of the inner peripheral surface, and that between the base plate back surface of the orbiting-scroll and a regulation surface to be used in common with a grind surface of an Oldham-coupling ring provided on the main frame side, there is interposed the flange portion, whereby the movable range of the thrust ring in the axial direction is regulated.

According to this invention, any new regulation surface is not provided on the main frame side unlike-the conventional case to restrict the movable range of the orbiting-scroll, but the movable range of the orbiting-scroll is indirectly regulated through the regulation surface of the thrust ring, whereby the fabrication cost of the main frame can be reduced.

The regulation surface depth of the main frame and the thickness of the flange portion of the thrust ring are selected for fitting, whereby it becomes possible to control the movable range, and the movable range can be regulated with higher precision at low cost. Even in this structure, the orbiting-scroll is capable of performing sufficiently stable movement, but in order to bring more stability, the flange portion of the thrust ring has preferably as large outer diameter as possible. In this case, under an operating pressure condition, in which a force in a direction that depresses the orbiting-scroll with respect to the fixed-scroll becomes substantially equal such as, for example, during starting, the force in the direction that depresses is capable of reducing a so-called overthrow motion in which the orbiting-scroll conducts like a falling piece because of fluctuation during one rotation of the orbiting-scroll.

On a grind surface of the flange portion which slidably contacts the base plate back surface of the orbiting-scroll, there is provided an annular groove, and further a communicating groove or a communicating hole which communicates the groove to suction pressure space formed on the outer periphery of the thrust ring is preferably formed along the radial direction of the flange portion. In this case, it is possible to form the suction pressure space between the grind surfaces with the orbiting-scroll, thus making it possible to prevent the thrust ring from departing from orbiting-scroll.

On the base plate back surface of the orbiting-scroll which slidably contacts the flange portion, there is provided an annular groove; further it may be possible to form a communicating groove or a communicating hole, which communicates the groove to suction pressure space formed on the outer periphery of the thrust ring, along the radial direction of the orbiting-scroll; it may be possible to form an annular groove on a grind surface between the thrust ring and the orbiting-scroll, and further to provide the groove with a communicating hole for penetrating in the axial direction of the thrust ring.

Also, in addition to the forgoing, it may be possible to provide the grind surface between the thrust ring and the orbiting-scroll with an annular groove, and to cause the groove to continuously or intermittently communicate to a key way which fits in an Oldham-coupling ring key on the base plate back surface of the orbiting-scroll.

DETAILED DESCRIPTION

Figure 1:
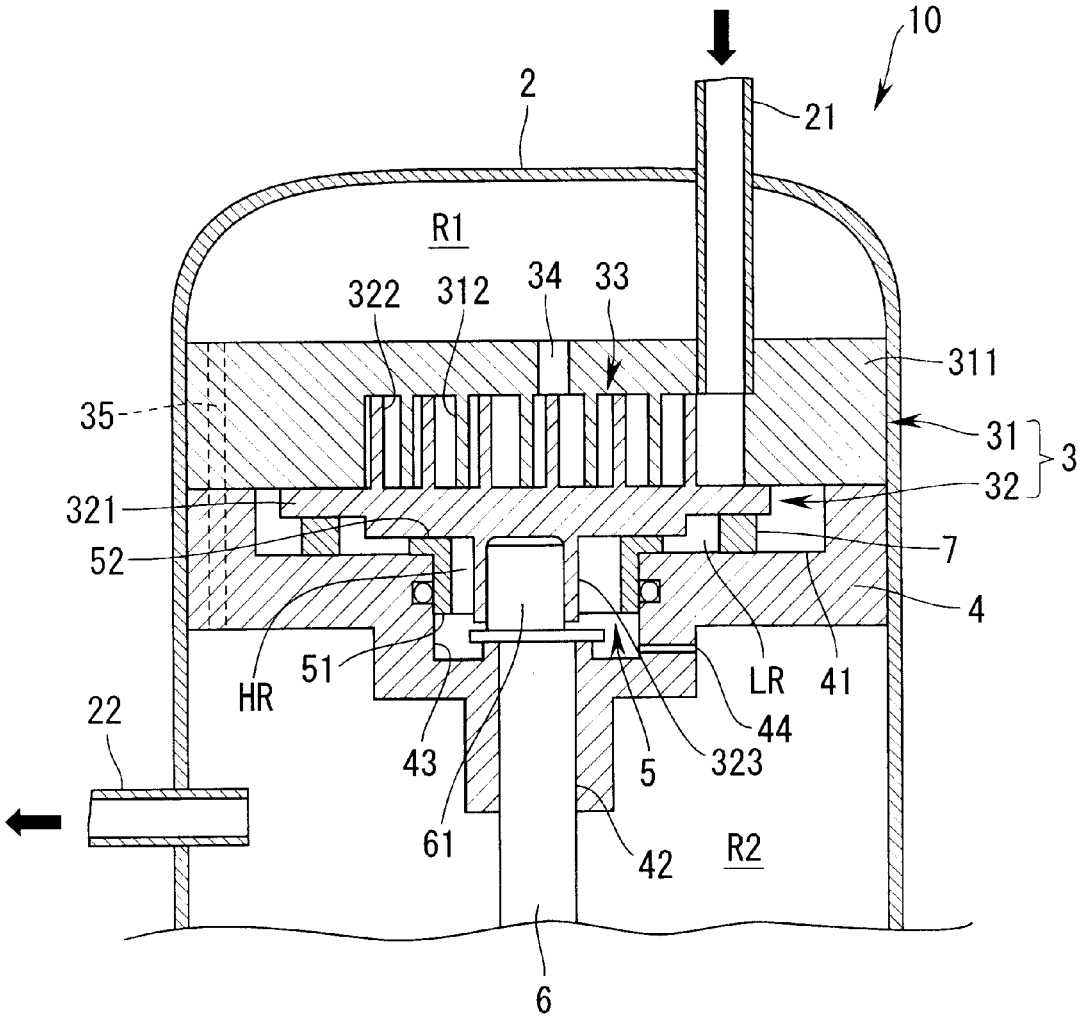
FIG. 1 is a partial sectional view showing a scroll compressor according to an embodiment of the present invention.
Figure 2:
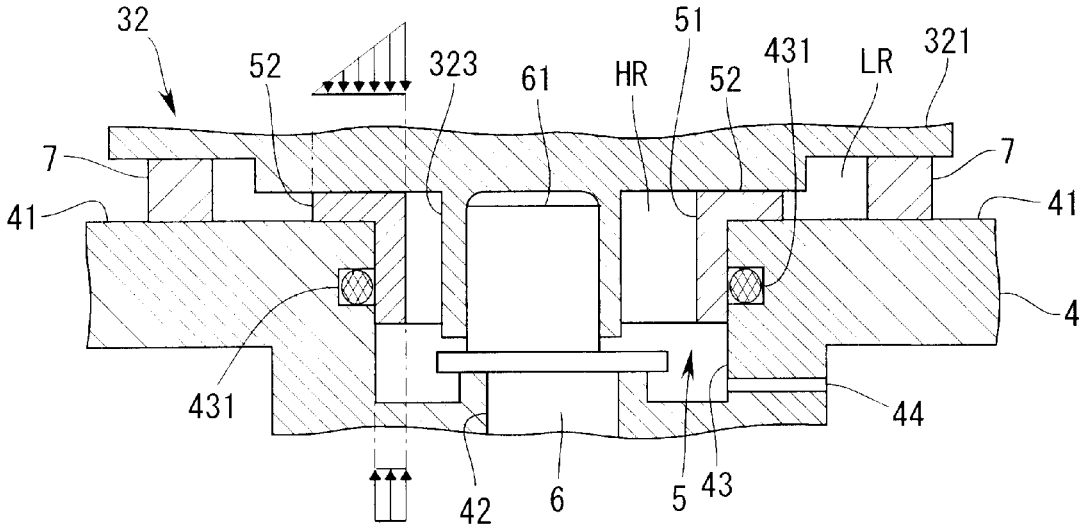
FIG. 2 is an enlarged view obtained by enlarging mainly a thrust ring of the scroll compressor of FIG. 1.
Figure 6:
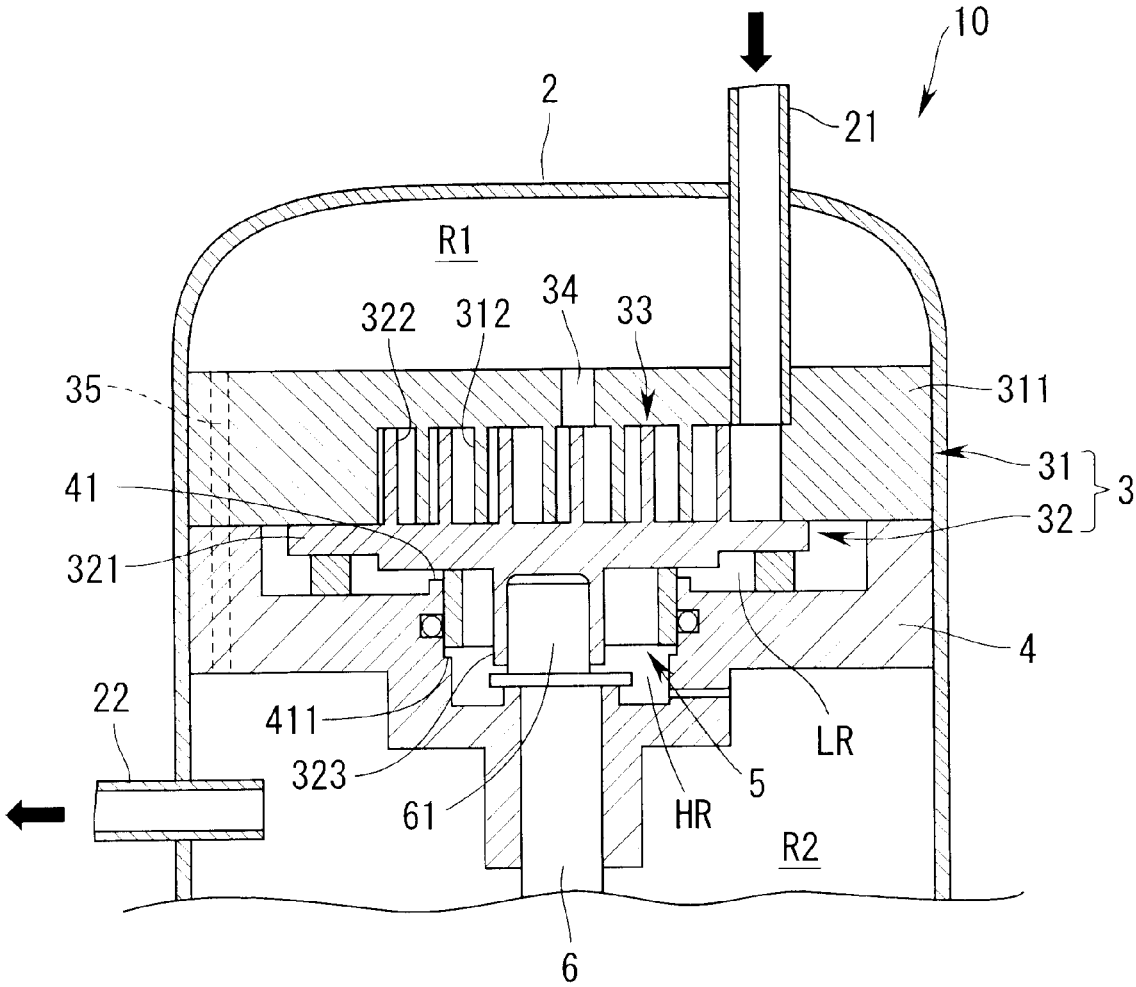
Fig. 6 Prior Art
FIG. 6 is a partial sectional view showing a conventional scroll compressor.

With reference to the drawings, the description will be made of an embodiment according to the present invention. FIG. 1 is a sectional view showing a scroll compressor according to an embodiment of the present invention, and FIG. 2 is an enlarged view obtained by enlarging mainly a thrust ring. In this respect, structural elements identical or to be regarded as identical to the conventional scroll compressor of FIG. 6 previously described are designated by the identical reference numerals.

This scroll compressor 10 has a cylindrically-formed hermetic shell 2, and in this embodiment, the interior of the hermetic shell 2 is partitioned into a refrigerant discharge chamber R1 and a driving chamber R2 by means of a main frame 4. Within the refrigerant discharge chamber R1, there is provided a refrigerant compressing section 3 comprising a fixed-scroll 31 and an orbiting-scroll 32 with their scrolled-wraps 312 and 322 combined with each other, and within this refrigerant compressing section 3, there is provided a compressing chamber 33 for compressing refrigerant.

On an outer periphery side of the scroll wrap 312 of the fixed-scroll 31, there is connected a refrigerant suction pipe 21 from the refrigerating cycle, and at the center, there is provided a discharge port 34 for discharging high-pressure refrigerant, which has been generated within the compressing chamber 33, within the refrigerant discharge chamber R1.

An electric motor is housed within the driving chamber R2 although not shown, and a rotary driving shaft of the electric motor is designated by a reference numeral 6. Also, within the driving chamber R2, there is stored lubricating oil, in a predetermined amount, for lubricating a driving unit. The rotary driving shaft 6 of the electric motor extends to the refrigerant compressing section 3 side through a main spindle hole 42 of the main frame 4, and a crankshaft 61 at its tip end is fitted in a boss 323 provided on the base plate 321 back surface of the orbiting-scroll 32. Within the driving shaft 6, there are formed lubricating holes which are not shown over their full length in the axial direction.

Between the main frame 4 and the refrigerant compressing section 3, there is provided a back-pressure chamber for the orbiting-scroll 32, and in this embodiment, the back-pressure chamber includes two back-pressure chambers: high pressure and low pressure. In order to form these two back-pressure chambers, the main frame 4 is, on the refrigerant compressing section 3 side, formed with a regulation surface 41 indented by one stage, and an inner surface 43 coaxially indented by further one stage from the regulation surface 41 along the rotary driving shaft 6 of the electric motor. On the regulation surface 41 of the main frame, there is slidably interposed an Oldham-coupling ring 7 for preventing rotation of the orbiting-scroll 32 so as to be slidable on the base plate back surface of the orbiting-scroll 32.

Between the main frame 4 and the refrigerant compressing section 3, there is housed a thrust ring 5. The thrust ring 5 has a larger diameter than a diameter of the inner peripheral surface 43, and its one end surface slidably contacts along the base plate back surface of the orbiting-scroll 32 while the other end surface has a flange portion 52 for abutting along the regulation surface 41, and a main body 51 of a ring, the outer peripheral surface of which is movably fitted along the inner peripheral surface 43 of the main frame 4 from the flange portion 52 over the other end.

By means of this thrust ring 5, on the outer side between the main frame 4 and the refrigerant compressing section 3, there is formed a first back-pressure chamber LR (low-pressure side), and on the inner side, there is formed a second back-pressure chamber HR (high-pressure side). The first back-pressure chamber LR communicates to outside low-pressure refrigerant space within the compressing chamber 33 through the side of the orbiting-scroll 32 and the Oldham-coupling ring 7. The second back-pressure chamber HR communicates to the driving chamber R2 through a clearance between the rotary driving shaft 6 and the main spindle hole 42 of the main frame, and an oil escape hole 44 of the main frame 4.

As regards fitting the thrust ring 5 in the inner peripheral surface 43 of the main frame 4, there is also a method for controlling those clearances in order to minimize pressure leakage, and in this embodiment, it is preferable to annularly form a seal groove 431 on the inner peripheral surface 43 and to provide a ring-shaped elastic seal member within the seal groove 431. In this case, it is possible to reliably seal between the main body 51 of the ring and the inner peripheral surface 43.

In the scroll compressor 1 constructed as described above, since the movable range of the orbiting-scroll 32 in the axial direction is regulated with a flange portion 52 of the thrust ring 5 interposed between the regulation surface 41 and the orbiting-scroll 32, it is not necessary to newly provide the regulation surface 41 with any regulation surface for dedicated use with the orbiting-scroll 32, but the scroll compressor 1 can be manufactured at low cost.

Even in the above-described structure, the orbiting-scroll 32 is capable of performing sufficiently stable movement, and depending upon the operating pressure condition such as, for example, during starting, a force in a direction that depresses the orbiting-scroll 32 with respect to the fixed-scroll 31 becomes substantially equal. Since the force in the direction that depresses fluctuates during one rotation of the orbiting-scroll 32 at this time, the orbiting-scroll may perform such overthrow motion as a falling piece. In order to reduce the overthrow motion to a minimum, the outer diameter of the flange portion 52 of the thrust ring 5 is preferably made as large as possible.

Also, when the outer diameter of the flange portion 52 is made larger than the outer diameter of the main body 51 of the thrust ring, a depressing force to be applied to the thrust ring 5 becomes greater, which may possibly not bring the thrust ring 5 into tight contact with the back surface of the orbiting-scroll.

Figure 3:
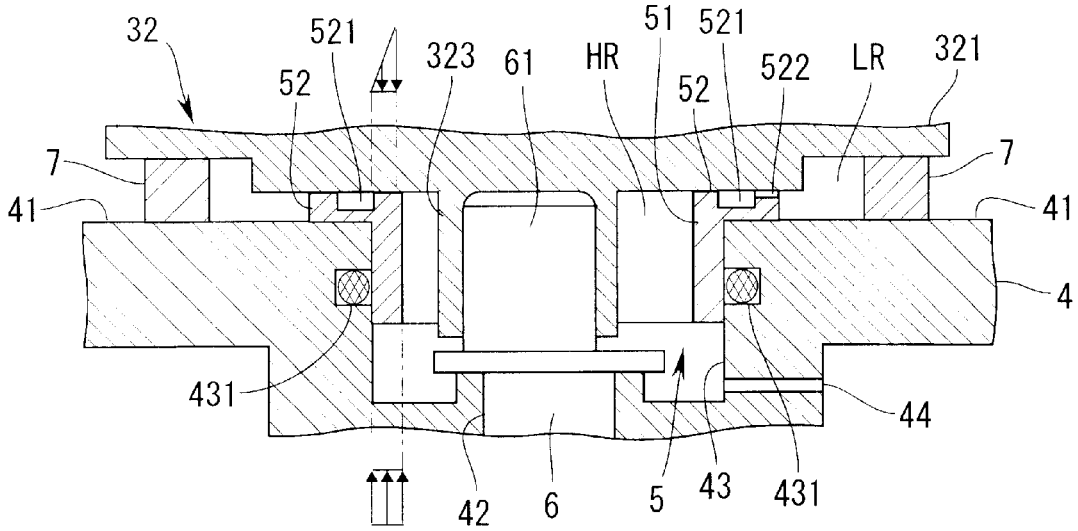
FIG. 3 is an enlarged view showing a first variation of the thrust ring.

As shown in the variation of FIG. 3, a slidably-contact surface of the flange portion 52 of the thrust ring 5 is provided with an annular thrust groove 521, and the thrust groove 521 is caused to communicate to the first back-pressure chamber LR, whereby an appropriate tight contact force can be obtained without changing the diameter of the flange portion 52. In this embodiment, the thrust groove 521 communicates to the first back-pressure chamber LR through a communicating hole 522 communicating in the radial direction of the flange portion 52.

According to this, since it is possible to reduce a force for causing the orbiting-scroll 32 to depart from the thrust ring 5, and to reduce the force in the depressing direction to be applied to the thrust ring 5, the thrust ring 5 is capable of reliably being kept brought into tight contact with the orbiting-scroll 32.

In this respect, in this first variation, the communicating hole 522 has been formed along the radial direction of the flange portion 52, but may be formed along the axial direction. In other words, it may be possible to form a communicating hole communicating in the direction of the wall thickness of the flange portion 52 so as to communicate to the first back-pressure chamber LR in a L-character shape from there, and this aspect is also included in the present invention.

Figure 4:
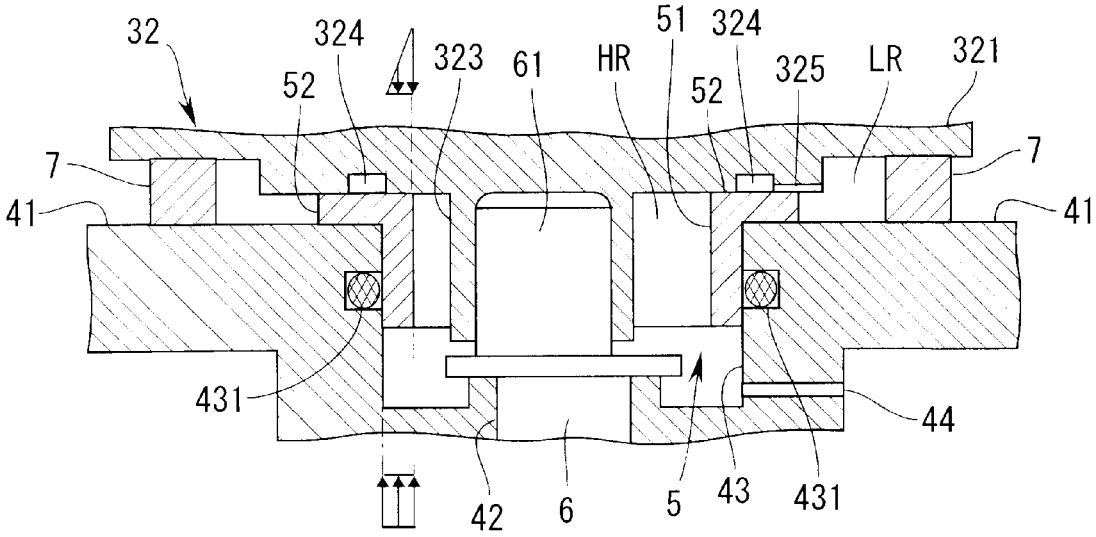
FIG. 4 is an enlarged view showing a second variation of the thrust ring.

As an example which exhibits a similar effect to the above-described variations, it may be possible to provide a groove 324 within a range of sliding between the back surface of the base plate 321 of the orbiting-scroll 32 and the thrust ring 5 as shown in FIG. 4 so as to form a communicating hole 325 communicating to the first back-pressure chamber LR from this groove 324 toward the radial direction, and the similar effect can be obtained even by this second variation.

Figure 5:
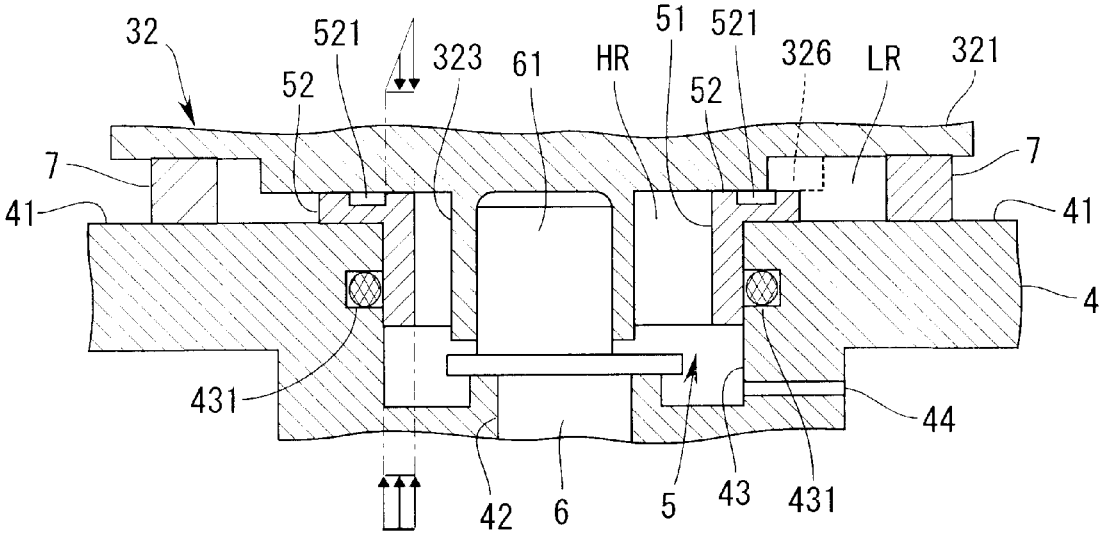
FIG. 5 is an enlarged view showing a third variation of the thrust ring.

FIG. 5 shows still another aspect. As a third variation, first, the flange portion 52 of the thrust ring 5 is formed with a similar annular groove 521 to the first variation. In this embodiment, without providing any above-described communicating hole, a part of a grind surface between the back surface of the base plate 321 of the orbiting-scroll 32 and the thrust ring 52 is cut out to form a cutout portion 326.

In this case, the orbiting-scroll 32 performs orbiting movement, whereby the cutout portion 326 intermittently communicates to the groove 521, and a substantially similar effect to the above-described variation can be obtained. Also, this cutout portion 326 may be one to be used in common with a key way for fitting in the Oldham-coupling ring key provided on the back surface of the orbiting-scroll 32.

In the foregoing, with reference to concrete aspects, the detailed description has been made in the present invention, and the range of the present invention specified in the claims should include changes and modifications, which can be easily performed by those skilled in the art who have understood the above-described contents and equivalent techniques.

What is claimed is:

1. A scroll compressor, comprising:

a main frame having an inner peripheral surface, a regulation surface, and a contact surface, an orbiting-scroll disposed above the main frame and having a base plate back surface facing the regulation surface and the contact surface, an Oldham-coupling ring disposed between the contact surface of the main frame and the base plate back surface of the orbiting-scroll for preventing rotation of the orbiting-scroll, and a thrust ring including a main body to be fitted in the inner peripheral surface of said main frame, and a flange portion formed at one side of the main body and slidably contacting the base plate back surface to thereby partition the base plate back surface into a plurality of pressure spaces, said flange portion having an outer diameter greater than an outer diameter of said inner peripheral surface and being disposed between the base plate back surface and the regulation surface flush with the contact surface where the Oldham-coupling ring is disposed so that a movable range of said thrust ring in the axial direction is regulated.

2. The scroll compressor according to claim 1, further comprising an annular groove on a contact surface of said flange portion which slidably contacts the base plate back surface of said orbiting-scroll, and a communicating groove or a communicating hole which communicates said groove to a suction pressure space formed on an outer periphery of said thrust ring and which is formed along a radial direction of said flange portion.

3. The scroll compressor according to claim 1, further comprising an annular groove on the base plate back surface of said orbiting-scroll which slidably contacts said flange portion, and a communicating groove or a communicating hole, which communicates said groove to a suction pressure space formed on an outer periphery of said thrust ring and is formed along a radial direction of said orbiting-scroll.

4. The scroll compressor according to claim 1, further comprising an annular groove on a contact surface between said thrust ring and said orbiting-scroll, said annular groove having a communicating hole for penetrating in the axial direction of said thrust ring.

5. The scroll compressor according to claim 1, further comprising an annular groove on a contact surface between said thrust ring and said orbiting-scroll, and said groove continuously or intermittently communicating to a key way which fits in an Oldham-coupling ring key on the base plate back surface of said orbiting-scroll.

6. The scroll compressor according to claim 1, wherein said main frame further includes a seal groove in the inner peripheral surface facing the main body of the thrust ring, an elastic seal being disposed in the seal groove to seal between the main frame and the thrust ring.

* * * * *